US008517772B2

(12) United States Patent
Wu

(10) Patent No.: US 8,517,772 B2
(45) **Date of Patent: *Aug. 27, 2013**

(54) CABLE HAVING ADAPTOR ASSEMBLY

(76) Inventor: Sung-Chiang Wu, New Taipei (TW)

( * ) Notice: Subject to any disclaimer, the term of this patent is extended or adjusted under 35 U.S.C. 154(b) by 95 days.

This patent is subject to a terminal disclaimer.

(21) Appl. No.: 13/293,137

(22) Filed: Nov. 10, 2011

(65) Prior Publication Data

US 2012/0252277 A1 Oct. 4, 2012

Related U.S. Application Data

(63) Continuation-in-part of application No. 13/077,954, filed on Mar. 31, 2011, now Pat. No. 8,298,003.

(51) Int. Cl.
*H01R 13/72* (2006.01)

(52) U.S. Cl.
USPC ..... 439/638; 439/501

(58) Field of Classification Search
USPC ..... 439/639, 638, 501, 640, 528, 527, 439/660, 502, 518, 175, 623; 361/679.01, 361/679.02, 679.08; 174/74 R, 72 R, 88 R, 174/78, 84 R, 250
See application file for complete search history.

(56) References Cited

U.S. PATENT DOCUMENTS

| | | | | |
|---|---|---|---|---|
| 5,184,960 | A * | 2/1993 | Hopkins et al. | 439/35 |
| 5,836,783 | A * | 11/1998 | Morisawa et al. | 439/502 |
| 6,733,328 | B2 * | 5/2004 | Lin et al. | 439/501 |
| 7,057,108 | B1 * | 6/2006 | Sodemann et al. | 174/71 R |
| 7,285,021 | B2 * | 10/2007 | Bell et al. | 439/623 |
| 8,298,003 | B2 * | 10/2012 | Wu | 439/501 |
| 2008/0194149 | A1 * | 8/2008 | Kim | 439/639 |

* cited by examiner

*Primary Examiner* — Renee S Luebke
*Assistant Examiner* — Harshad Patel
(74) *Attorney, Agent, or Firm* — Leong C. Lei

(57) ABSTRACT

The cable contains a cable member, a first connector electrically connected to an end of the cable member, a split member electrically connected to the other end of the cable member and having at least a second connector, at least an adaptors capable of electrically connecting to the second connector; and a joint member having a ring element for joining to the cable member and at least an extension element for joining to the adaptor. The cable, with the first connector and the other connectors on the adaptors, can be used to interface various appliances.

10 Claims, 5 Drawing Sheets

CABLE HAVING ADAPTOR ASSEMBLY

CROSS-REFERENCE TO RELATED APPLICATION

This application is a continuation-in-part of the patent application Ser. No. 13/077,954, filed Mar. 31, 2011, now U.S. Pat. No. 8,298,003 owned by the same applicant.

(a) TECHNICAL FIELD OF THE INVENTION

The present invention is generally related to adaptors, and more particular to a cable having an adaptor assembly providing multiple connection interfaces.

(b) DESCRIPTION OF THE PRIOR ART

Digital appliances such as smart phones, tablet computers, 3C (computers, communications and consumer) appliances are widely popular these days. However, these appliances are usually equipped with various different data transmission or charging interfaces, and they requires various adaptor cables for connecting with each other or with the USB port of a computer for data transmission.

As shown in FIG. 1, a conventional cable 200 has USB or different connectors at its two ends, and a number of adaptors to interface with the USB connectors and different appliances. These separate and detachable adaptors are troublesome to carry and, once one is missing, some interfacing work cannot be achieved.

SUMMARY OF THE INVENTION

Therefore a novel cable is provided herein. The cable contains a cable member, a first connector electrically connected to an end of the cable member, a split member electrically connected to the other end of the cable member and having at least a second connector, at least an adaptors capable of electrically connecting to the second connector; and a joint member having a ring element for joining to the cable member and at least an extension element for joining to the adaptor.

Preferably, the first connector is a USB connector.

Preferably, the first connector is a connector conforming to an appropriate standard specification.

Preferably, a plug element is configured at an outer end of the extension element.

Preferably, the adaptor contains at least a notch along an outer edge for accommodating a plug element.

Preferably, the joint member is joined to the cable member by threading, plugging, adhering, or integrally forming.

Preferably, the second connector is capable of connecting to an USB connector, a MINI USB connector, a MICRO USB connector, a HDMI connector, a connector for a tablet computer, a connector to a smart phone, or a connector to a 3C (computers, communications and consumer) appliance.

Preferably, the adaptor contains at least two connectors for different interfaces and the two connectors are electrically connected inside the adaptor.

Preferably, the adaptor is capable of connecting to an USB connector, a MINI USB connector, a MICRO USB connector, a HDMI connector, a connector for a tablet computer, a connector to a smart phone, or a connector to a 3C (computers, communications and consumer) appliance.

Preferably, the joint member is made of rubber or other flexible material.

The foregoing objectives and summary provide only a brief introduction to the present invention. To fully appreciate these and other objects of the present invention as well as the invention itself; all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
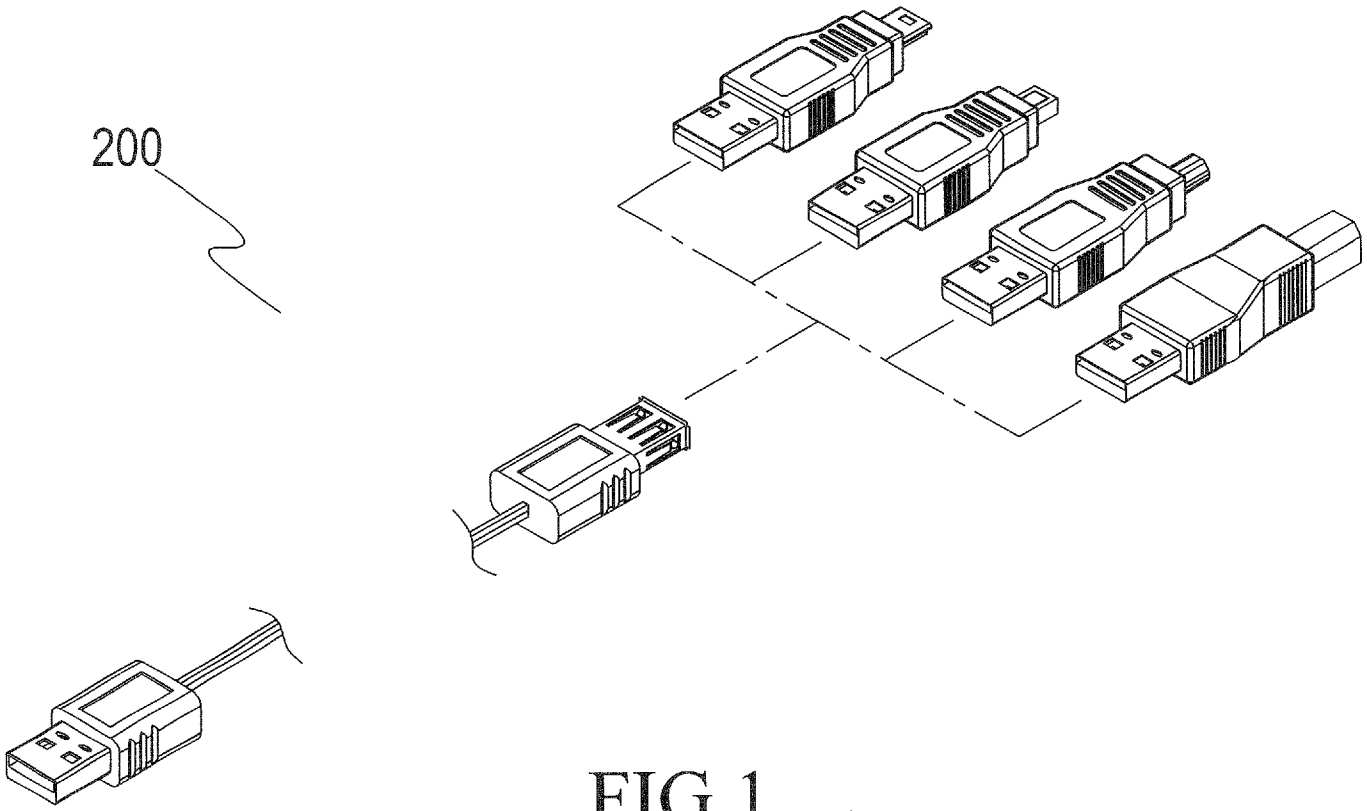
FIG. 1 PRIOR ART
FIG. 1 is a perspective diagram showing a conventional cable with multiple adaptors.
Figure 2:
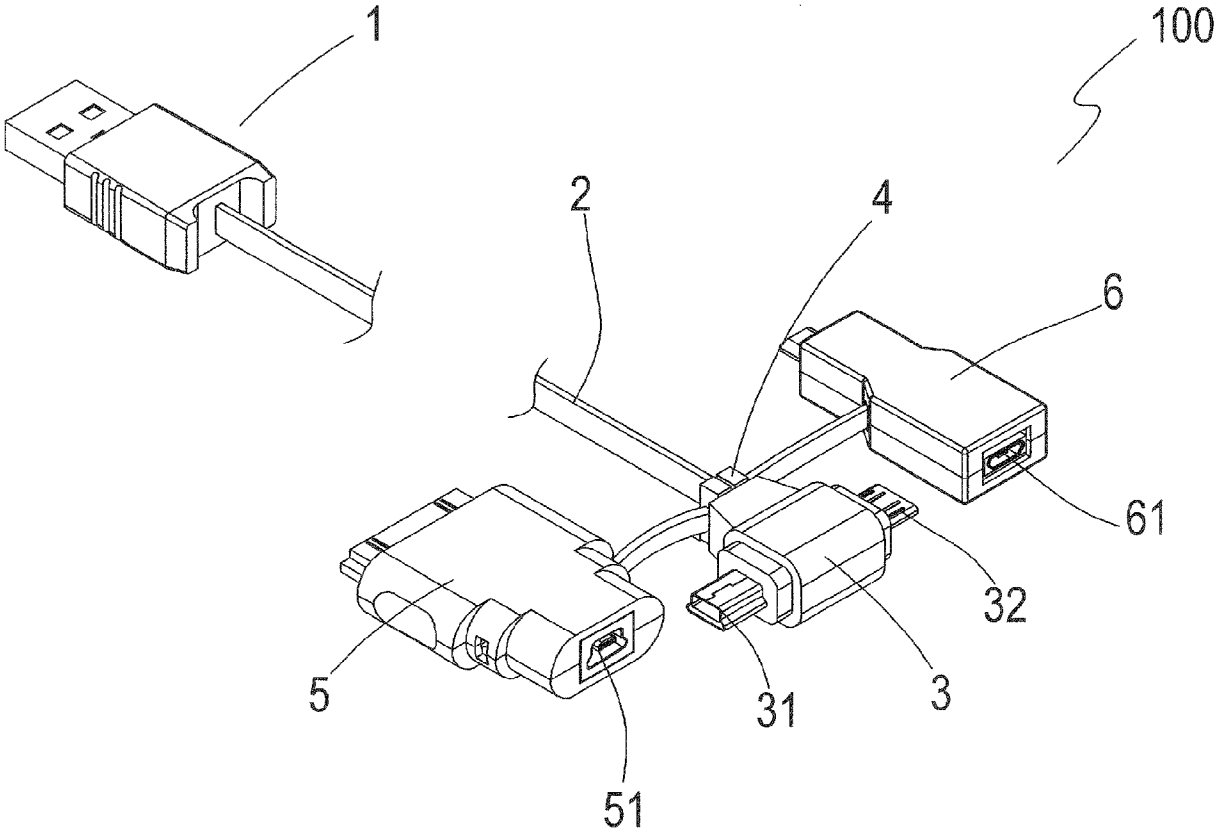
FIG. 2 is a perspective diagram showing a cable having an adaptor assembly according to an embodiment of the present invention.

As shown in FIG. 2, a cable 100 having an adaptor assembly contains a cable member 2, a connector 1 at an end of the cable member 2, a split member 3 at the other end of the cable member 2, a joint member 4, and two adaptors 5 and 6.

Figure 3:
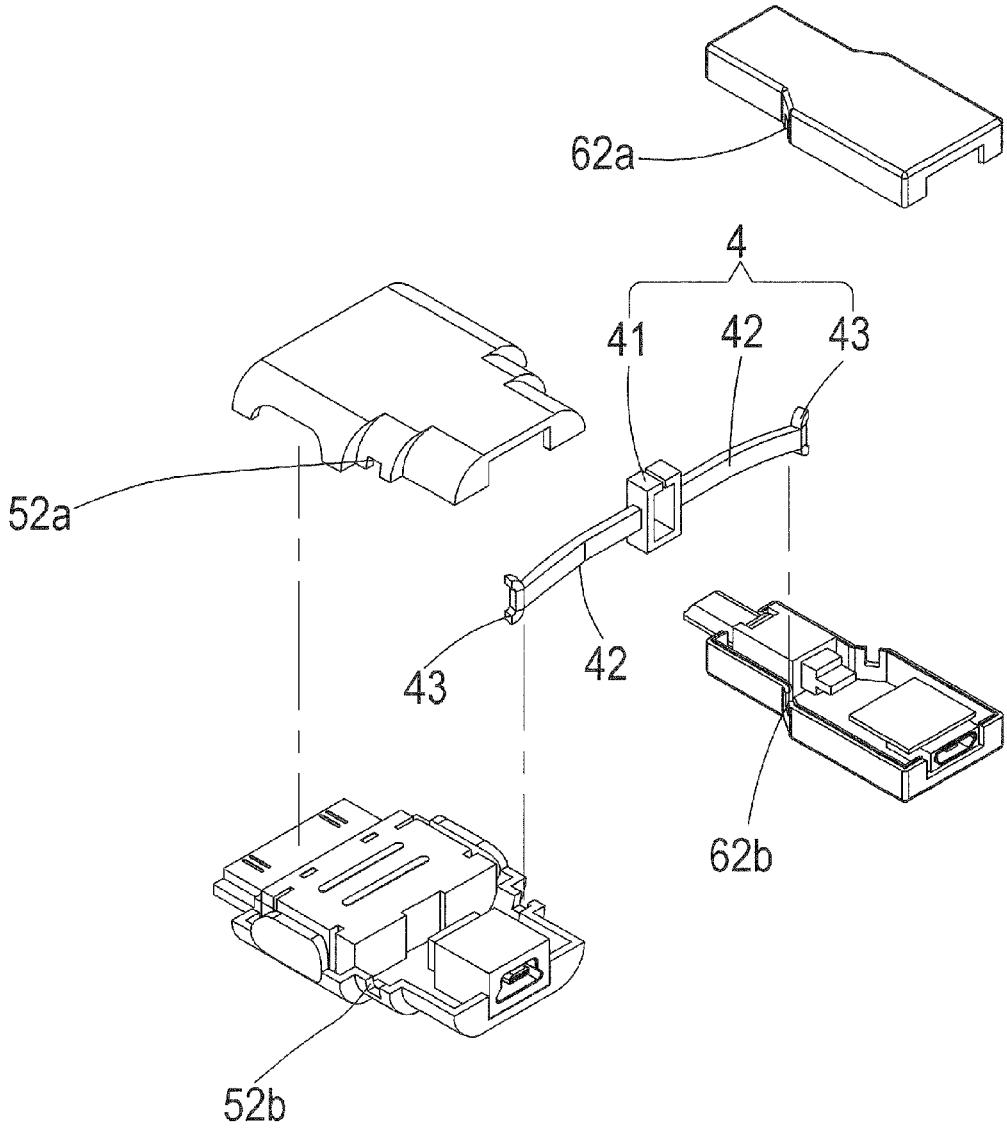
FIG. 3 is a perspective diagram showing the assembly of two adaptors of the cable of FIG. 2.
Figure 4:
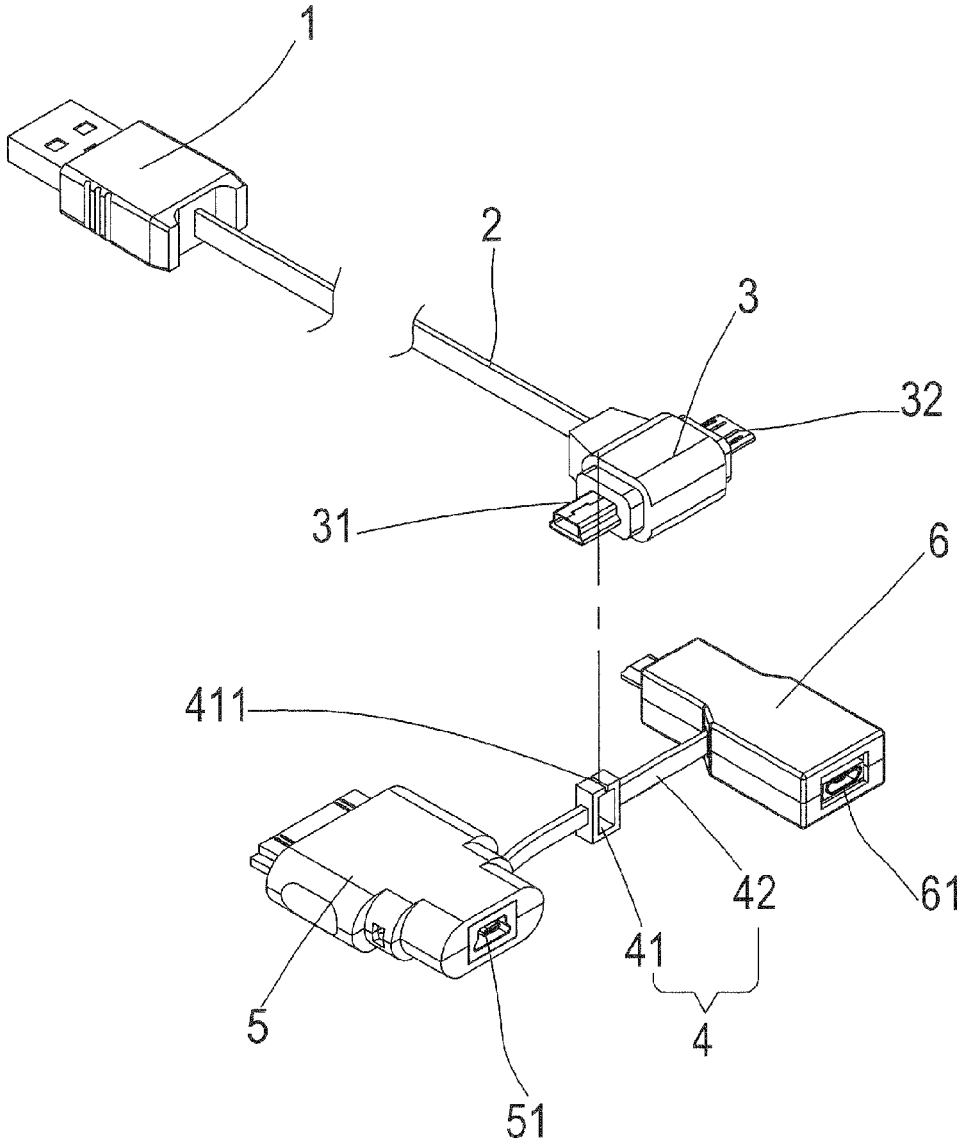
FIG. 4 is a perspective diagram showing the assembly of the adaptors to a cable member of the cable of FIG. 2.

As shown in FIGS. 3 and 4, adaptors 5 and 6 contain a top piece and a bottom pieces, respectively. Along an outer edge of the top and bottom pieces, there are corresponding notches 52*a*, 52*b*, 62*a*, and 62*b*, respectively. On the other hand, the joint member 4 contains a ring element 41 and two extension elements 42 extended laterally from the ring element 41. At an outer end of each extension element 42, there is a plug element 43. When the top and bottom pieces are joined together with an extension element 42 housed inside, the plug elements 43 are accommodated by the spaces formed by the corresponding notches 52*a*, 52*b*, 62*a*, and 62*b*. The ring element 41 is for joining to the split member 3 by threading, plugging, adhering, or integrally forming. If plugging is used, the ring element 41 has a slot 411 through which the cable member 2 can be plugged. The adaptors 5 and 6 have sockets 51 and 61 for receiving the plugs 31 and 32 of the split member 3.

Figure 5:
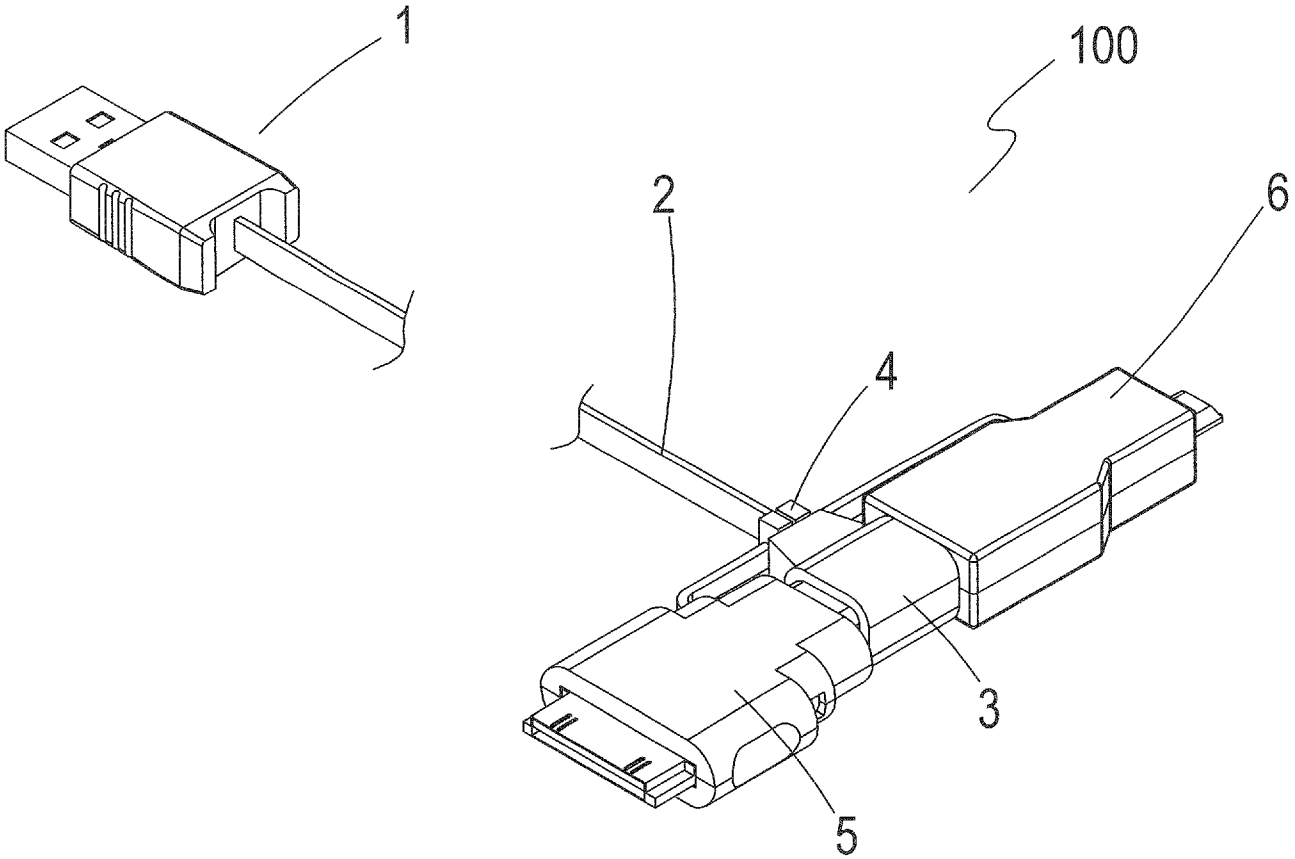
FIG. 5 is a perspective diagram showing the cable of FIG. 2 after its assembly.

As such, the adaptors 5 and 6 can be connected to the split member 3 and, along with the joint member 4, will not be easily lost, as shown in FIG. 5. The cable 100, with the connector 1 and the other connectors on the adaptors 5 and 6, can be used to interface various appliances.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cable, comprising:

a cable member;

a first connector electrically connected to an end of said cable member;

a split member electrically connected to other end of said cable member and having at least a second connector;

at least an adaptor electrically capable of connecting to said second connector; and a joint member having a ring element for joining to said cable member and at least an extension element for joining to said adaptor.

2. The cable according to claim 1, wherein said first connector is a USB connector.

3. The cable according to claim 1, wherein said first connector is a connector conforming to an appropriate standard specification.

4. The cable according to claim 1, wherein a plug element is configured at an outer end of said extension element.

5. The cable according to claim 1, wherein said adaptor contains at least a notch along an outer edge for accommodating a plug element.

6. The cable according to claim 1, wherein said joint member is joined to said cable member by one of threading, plugging, adhering, and integrally forming.

7. The cable according to claim 1, wherein said second connector is capable of connecting to one of an USB connector, a MINI USB connector, a MICRO USB connector, an HDMI connector, a connector for a tablet computer, a connector to a smart phone, and a connector to a 3C (computers, communications and consumer) appliance.

8. The cable according to claim 1, wherein said adaptor contains at least two connectors for different interfaces and said connectors are electrically connected inside said adaptor.

9. The cable according to claim 1, wherein said adaptor is capable of connecting to one of an USB connector, a MINI USB connector, a MICRO USB connector, a HDMI connector, a connector for a tablet computer, a connector to a smart phone, and a connector to a 3C (computers, communications and consumer) appliance.

10. The cable according to claim 1, wherein said joint member is made of rubber.

* * * * *